US006124248A

United States Patent [19]

O'Bryant et al.

[11] Patent Number: 6,124,248

[45] **Date of Patent: *Sep. 26, 2000**

[54] ORGANIC LUBRICANTS AND COOLANTS

[75] Inventors: Jeff C. O'Bryant, Gig Harbor, Wash.; Deborah L. O'Bryant, 8626 92nd St., NW., Gig Harbor, Wash. 98332

[73] Assignees: Jeffrey C. O'Bryant; Deborah L. O'Bryant

[ * ] Notice: This patent is subject to a terminal disclaimer.

[21] Appl. No.: 09/120,033

[22] Filed: Jul. 21, 1998

Related U.S. Application Data

[63] Continuation of application No. 08/897,891, Jul. 21, 1997, Pat. No. 5,851,963.

[51] Int. Cl.[7] ..... C10M 9/00; C10M 173/02

[52] U.S. Cl. ..... 508/216; 72/42

[58] Field of Search ..... 508/216

[56] References Cited

U.S. PATENT DOCUMENTS

| | | | |
|---|---|---|---|
| 4,059,604 | 11/1977 | Kresse | 554/14 |
| 4,115,282 | 9/1978 | Grasshoff | 508/216 |
| 4,233,075 | 11/1980 | Picone | 106/3 |
| 4,765,917 | 8/1988 | Otaki et al. | 508/121 |
| 5,116,521 | 5/1992 | Fujii et al. | 508/163 |
| 5,851,963 | 12/1998 | O'Bryant | 508/216 |

*Primary Examiner*—Ellen M. McAvoy

[57] ABSTRACT

Mucilages and mucilage extracts are disclosed that are effective as water-soluble, non-toxic, biodegradable, environmentally benign lubricants and/or coolants for a variety of industrial and machining purposes. One embodiment of the invention is a cooling and/or lubricating composition comprises a sufficient amount of the mucilage to cool and/or lubricate a machining surface. Other embodiments further comprise a sufficient amount of a preservative to substantially inhibit degradation of the composition. Also encompassed within the scope of this invention are methods for making mucilage-comprising cooling and/or lubricating compositions, as well as concentrating and drying such compositions. Other aspects of this invention are methods for machining a surface, comprising extracting a mucilage, adding a sufficient amount of a preservative to substantially inhibit degradation of the mucilage to form a mucilage mixture, applying the mucilage mixture to a surface to be machined, and thereafter machining the surface. In another aspect, the invention provides methods for lubricating and/or cooling a machining surface comprising extracting a mucilage, adding a sufficient amount of a preservative to substantially inhibit degradation of the mucilage to form a mucilage mixture, and applying the mucilage mixture to the machining surface to act as a lubricant and/or coolant. A farther aspect of this invention is the use of plant mucilages to coat the outer hull of watercraft, thereby reducing friction and drag, and increasing the speed of the craft. Optionally, such a composition may further comprise a cream wax.

66 Claims, No Drawings

ORGANIC LUBRICANTS AND COOLANTS

CROSS REFERENCE TO RELATED APPLICATION

This application is a continuation of Ser. No. 08/897,891, filed Jul. 21, 1997, now U.S. Pat. No. 5,851,963 which is incorporated herein by reference.

FIELD OF THE INVENTION

This invention concerns plant extract-based compositions useful as lubricants and/or coolants, and methods for their manufacture and use.

BACKGROUND OF THE INVENTION

Lubricant and/or coolant fluids are used for a variety of machining purposes, including cutting, drilling, sawing, and other processes involving friction and frictional heating between two or more bodies. Lubricant and/or coolant fluids commonly used for such processes are petroleum-based. Residue of these petroleum-based fluids must be removed using organic solvents such as petroleum distillates or chlorine solvents (e.g., 1,1,1-trichloroethane or trichloroethylene). These solvents contaminate the environment and pose health and safety hazards.

Some water-soluble lubricants exist. See, for instance, U.S. Pat. No. 4,636,321 "Water Soluble Lubricants," Kipp et al., 1987. This patent discloses a blend of polyakylene gylcol polymer(s), ethoxylated carboxylic acid(s) or alcohol(s), complex organic phosphate ester(s), alkanolamine(s), and water as a lubricant for high-pressure applications such as cold rolling of metals. Currently available water-soluble lubricants are generally costly to produce and still pose health and safety hazards.

The taxonomic family Malvaceae includes those plants commonly referred to as the mallow family. The origin of this family is probably Africa or Asia, and certain members have been cultivated since the 12th century BC. In addition to ornamental varieties, such as ornamental hibiscus, the Malvaceae family includes both cotton (grown for fibers from its seed head or boll) and okra. Okra (*Abelmoschus esculentus* (*Hibiscus esculentus*)) is a tropical plant grown extensively for the food value of its seedpods. The pods, which are harvested while immature and tender, are used for a variety of culinary purposes. Texas, Georgia, Florida, California, Tennessee, and Alabama are major okra-producing states in the U.S.

Plants in the family Malvaceae have been used in home medicine for many years. For instance, the leaves of *Hibiscus rosa-sinesis* L. (Shimizu et al. (1993) *Biol. Pharm. Bull.* 16(8):735–739) and flower buds from *Hibiscus syriacus* L. (Tomoda and Ichikawa (1987) *Chem. Pharm. Bull.* 35(6):2360–2365) have been used as treatments for various medical conditions. It is thought that the medical properties of these tissues might be conferred by the copious mucilages found in these and related plants. Recent studies have examined and compared the mucilages found in the tissues of several Malvaceae species (Tomoda et al. (1989) *Carbo. Res.* 190:323–328), as well as the tissues of plants beyond the Malvaceae family (Yamada et al. (1985) *Carbo. Res.* 144: 101–111). These studies focus on the anti-complementary activity of the polysaccharides found in these mucilages.

Highly purified okra polysaccharide has been used to enhance cardiac output (U.S. Pat. No. 4,154,822 "Polysaccharide for Enhancement of Cardiac Output," Poimeni et al., 1979). This patent discloses using a highly purified polysaccharide from okra pod tissue to modify the fluidity of blood in vivo, thereby providing increased blood flow through the heart. It was proposed that this medical property was the result of chemical interactions between blood cells and the extended, highly purified, substantially linear polysaccharide when it was suspended in blood.

Common flax (*Linum usitatissumum*) is a member of the flax family, grown extensively for the production of linen fibers (from the stem) and linseed oil (from the seeds). Flax fiber has been used for cloth for nearly 10,000 years; flax has been grown for linen in North America since at least as early as 1626. In the late 1800's, cotton replaced linen as the preferred clothing-fiber source in North America, and since then flax has been cultivated in the United States mainly for its seed. Though flax probably originated and can be grown in tropical climates, seed crops are better in cooler climates. Generally, flaxseed is first processed to harvest linseed oil (30–40% by weight), leaving linseed meal. This product contains 30–40% crude protein, and is valuable as feed for livestock. Linseed oil is used in the manufacture of paints, vanishes, linoleum, oilcloth, printing inks, and soaps, as well as to seal concrete pavements and other structures.

Particularly desirable would be lubricant and/or coolant fluids that could be removed using water and that would be non-toxic, biodegradable, environmentally benign, and readily available from a renewable resource. It also would be advantageous if the lubricant could be reclaimed/recycled for repeated use.

SUMMARY OF THE INVENTION

The inventors have discovered that mucilages and mucilage extracts from flax and members of the taxonomic family Malvaceae are effective as water-soluble, non-toxic, biodegradable, environmentally benign lubricants and/or coolants for a variety of industrial and machining purposes. These compositions provide a reduction in the temperature of the machining surfaces greater than that provided by conventional coolant/lubricant compositions. They also are effective as drag-reducing watercraft outer hull coatings. As engine coolants, the compositions of this invention are superior to prior art engine coolants, in that they reduce the engine oil temperature by as much as 60° F. In addition, the mucilage-comprising compositions are inherently renewable, and can be easily reclaimed and recycled repeatedly.

One embodiment of the current cooling and/or lubricating composition comprises a sufficient amount of the mucilage to cool and/or lubricate a machining surface. The mucilage may comprise a substantially linear glycan having an apparent molecular weight of at least $10^6$ daltons. The mucilage is extracted from a plant tissue, and more specifically from a plant tissue selected from flax, members of the taxonomic family Malvaceae, and mixtures of these plants. One currently preferred plant tissue is okra, and more specifically okra pods. In another preferred embodiment, the plant from which the mucilage is extracted is flax, and more specifically flaxseed. Further compositions also comprise a sufficient amount of a preservative to substantially inhibit degradation of the composition. The preservative can be any conventional preservative, but is preferably an environmentally benign preservative. Preferred preservatives are sodium sulfite, hydrogen peroxide, colloidal silver, and mixtures thereof. Preferably the amount of any preservative will range from about 0.001 to about 8 percent (w/v), more preferably from about 0.01 to about 4 percent, and more preferably still from about 0.01 to about 3 percent.

Also encompassed within the scope of this invention are methods for making cooling and/or lubricating compositions, including the step of extracting a mucilage from plant tissue through physical means (e.g. crushing), and/or fluid/solvent assisted means. The fluid used in any solvent-assisted extraction in this invention may be water, solvents sufficiently polar to extract the mucilage, and mixtures thereof. In certain embodiments, the method comprises adding a sufficient amount of a preservative to substantially inhibit degradation of the composition. Optionally, an insoluble plant component may be removed prior to use of the composition. The use of various plant tissues (for instance from flax and members of the taxonomic family Matvaceae) is disclosed for use in making cooling and/or lubricating compositions. Also disclosed are methods for making cooling and/or lubricating compositions further comprising the additional step of concentrating the mucilage after the step of removing the insoluble plant component. This concentration step may be carried out by any conventional means, for instance evaporation of volatile materials or spray drying techniques. Included also are methods wherein the evaporation is carried on for a period of time sufficient to dry the mucilage. Preservatives as disclosed may be added before such drying step, after it, or both before and after it.

Further aspects of this invention are methods for machining a surface, comprising extracting a mucilage, adding a sufficient amount of a preservative to substantially inhibit degradation of the mucilage to form a mucilage mixture, applying the mucilage mixture to a surface to be machined, and thereafter machining the surface. In another aspect, the invention provides methods for lubricating and/or cooling a machining surface comprising extracting a mucilage, adding a sufficient amount of a preservative to substantially inhibit degradation of the mucilage to form a mucilage mixture, and applying the mucilage mixture to the machining surface to act as a lubricant and/or coolant. The machining surface in these methods can be, for example, a saw blade, a drill bit, a plane, a milling edge, a folding edge, a roller, a wheel, a grinding bit, a burr, or a lathe blade. The disclosed mucilage extracts also can be used to cool and/or lubricate a combustion engine. A further aspect of this invention relates to the use of plant mucilages to coat the outer hull of watercraft, thereby reducing friction and drag, and increasing the speed of the craft. Accordingly, a watercraft outer hull coating composition comprising mucilage is disclosed. Optionally, such a composition may further comprise a cream wax.

The foregoing and other aspects of the invention will become more apparent from the following detailed description.

DETAILED DESCRIPTION OF THE INVENTION

I. Definitions

Unless otherwise noted, technical terms are used according to conventional usage. Definitions of terms common in biochemistry may be found in Kendrew et al. (eds.), *The Encyclopedia of Molecular Biology,* published by Blackwell Science Ltd., 1994 (ISBN 0-632-02182-9). All amounts expressed in percentage (for instance, 0.015 percent colloidal silver) are weight per volume (w/v) measurements unless otherwise indicated.

In order to facilitate review of the various embodiments of the invention, the following definitions are provided. These definitions are not intended to limit such terms to a scope narrower than would be known to a person of ordinary skill in the field of lubricants and/or coolants.

Coolant and/or lubricant: A substance intended to provide either cooling or lubricating qualities, or both.

Coolants absorb heat from their environment and effectively transfer this heat away from its source. Conventional coolants used in industrial settings include water, soda water, lard oil, kerosene, and turpentine, or combinations of these. In addition to their use in industrial processes (for instance, on saw blades, drill bits, planes, milling edges, folding edges, rollers, wheels, grinding bits, burrs, or lathe blades) coolants are used in a variety of other processes, including engine radiators and air conditioners.

Lubricants reduce friction between two surfaces that are in close contact with each other. These surfaces may, for instance, be solid surfaces including metal, plastic, synthetic polymer, naturally occurring polymer, synthetic composite, glass and wood. In the machining arts, lubricants often serve the additional purpose of cooling both the tool and the material being machined, as well as removing chips, dust, etc., from the active work area. Conventional lubricants include, for instance, water, oil, grease, and graphite.

Extract: A fluid removed from plant tissue by, for instance, physical or solvent-assisted means. An extract can be concentrated through commonly known methods, including evaporation of some or all of the volatile components of the fluid. For instance, if an extract has been made using a solvent-assisted method, it may be beneficial to subsequently remove some or all of the solvent. It will be clear to one of ordinary skill in the art that such a concentration process can be carried out until all volatile materials have been removed, leaving in a dry state elements of the original extract that were dissolved or suspended in the original fluid. This dried extract can then be comminuted by, for example, grinding to form a powder. Alternately, a spray drying technique as is known in the art can be used. In any case, the resultant powder can be re-solubilized in a polar solvent of choice, particularly water and certain organic solvents, and the resultant fluid generally will retain the cooling and/or lubricating characteristics of the original plant extract.

Extraction (to extract): To remove a fluid component from plant material by physical and/or solvent-assisted means. In some instances, it is possible to extract a fluid component from plant material by soaking the plant material in a solvent, for instance water or other polar solvents. Alternatively, a fluid component can be extracted from plant material by comminuting, crushing, squeezing, mashing, chopping, macerating, homogenizing, etc., the plant material thereby releasing a fluid component from insoluble plant tissue. It may be beneficial to perform this physical process with or in a solvent, for instance water or other polar solvents, in order to separate the desired fluid component more fully from insoluble plant material. Such insoluble plant material may include, for instance, seed hulls, cell wall fragments, vascular tissue, or fibers. In any of these processes, it may be beneficial to heat the plant tissue, solvent, or mixture thereof to aid in or accelerate the release of the fluid component.

Flax: *Linum usitatissumum.* A member of the flax family, grown extensively for the production of linen fibers (from the stem) and linseed oil (from the seeds).

Glycan: A general term including both polymers composed wholly or largely of sugars, and the carbohydrate component of glycoconjugates. One type of a glycan is a substantially linear glycan. A substantially linear glycan has an extended backbone of glycosidically linked monosaccharides, and may additionally have side-chains of one to 12 monosaccharide units. Substantially linear glycans may in addition be linked to other, non-carbohydrate molecules. A substantially linear polysaccharide is one type of substantially linear glycan.

Machining: Industrial processes that in some manner change the shape or form of a solid surface. These processes include, for instance, cutting, drilling, sawing, lathing, milling, rolling, and folding. Surfaces that can be machined include, but are not limited to, metals, plastics, synthetic polymers, naturally occurring polymers, synthetic composites, glass and wood.

Malvaceae: The taxonomic family of plants commonly referred to as the mallow family. In addition to ornamental varieties currently produced for the gardener (including ornamental hibiscus), the Malvaceae family includes both okra (*Abelmoschus esculentus* (*Hibiscus esculentus*)), which is grown extensively for the food value of its seedpods, and cotton, grown for the fibers in its bolls.

Monosaccharide: A single-unit, low molecular weight sugar (carbohydrate). Generally, they comprise a chain of carbon atoms to which hydrogen and oxygen atoms are attached in the proportion of one carbon atom to two hydrogen atoms to one oxygen atom ($CH_2O$). For five- and six-carbon monosaccharides, the carbon chain generally exists in a ring-formation when the carbohydrate is dissolved in water. By the formation of a glycosidic linkage between each successive monosaccharide unit, monosaccharides can be linked together to form oligosaccharides or polysaccharides.

Mucilage: A plant product extracted from plants through either physical means (e.g. crushing) and/or solvent-mediated means (e.g. extraction using water). Mucilage is a crude mixture comprising intra- and/or inter-cellular plant cell constituents. Though a predominant component of mucilage is often a heterogeneous collection of large glycans, it may also include other compounds, for instance simple carbohydrates, proteins, organic acids, or pigments. Individual components of mucilage may be either dissolved or suspended in a plant fluid base, depending upon the chemical characteristics and concentration of each component. If mucilage is extracted from plant tissue using solvent-assisted means, the resultant extract is referred to as mucilage extract.

For the purposes of the present invention, individual components of crude mucilage need not be isolated from the mucilage or purified as a primary component of a lubricating and/or cooling composition. Moreover, it usually is desirable not to isolate or purify such compounds because purification adds further processing steps.

Polysaccharide: A polysaccharide is a polymer of monosaccharides, made of many monosaccharide units chemically (glycosidically) linked to each other. Naturally occurring polysaccharides serve, for instance, as a storage form of sugars (e.g. starch), or as structural components (e.g. cellulose and chitin).

Some naturally occurring polysaccharides are linked to non-carbohydrate components to form glycoconjugates. The non-carbohydrate component can be, for instance, protein or lipid. Where the non-carbohydrate component is proteinaceous, these glycoconjugates include proteoglycans (predominantly carbohydrate component with relatively little protein component) and glycoproteins (predominantly protein component with relatively little carbohydrate component).

Many plants are known to produce polysaccharides for a variety of biological purposes, including as a component of mucilage. Due to their possible medical activities, several polysaccharides produced by members of the taxonomic family Malvaceae have been characterized. See, for instance, Yamada et al. (1985) ("Relationship Between Chemical Structure and Anti-Complementary Activity of Plant Polysaccharides") and Tomada et al. (1988) ("Anti-complementary and Hypoglycemic Activity of Okra and Hibiscus Mucilages").

Preservative: Any agent that prolongs the useful life of a material. Preservatives include antioxidants, anti-microbial compounds (fungicides, bactericides, bacteriostatics, etc.), and mixtures thereof. Specific examples of appropriate preservatives include, for instance, benzalkonium chloride, tris(hydroxymethyl)-nitromethane, THPS, grapefruit seed extract, sodium sulfite, isopropyl alcohol, citric acid, calcium propionate, ethylene diaminetetraacetate (EDTA), hydrogen peroxide, propylene glycol, colloidal silver, colloidal silver essence, and olive leaf oil. In the context of the current specification, preservatives are used to increase the useful life of the coolant and/or lubricant composition by decreasing the amount and/or likelihood of degradation of the composition. Substantial inhibition of degradation occurs at a level of preservative sufficient to permit the coolant and/or lubricant composition to be maintained in a useful condition at room temperature (at or near 70° F.) for a desired period of time.

Antioxidant (anti-rust) preservatives can serve the additional purpose of preventing or substantially inhibiting oxidation and the resultant corrosion of surfaces to which the disclosed composition is applied. Appropriate antioxidants include hydrogen peroxide and amine or carboxylic acid salts such as triethanolamine, EDTA, amine borates, and amine carboxylates.

II. Preparation of Lubricant and/or Coolant

Mucilage appropriate for use as a lubricant and/or coolant can be extracted from the tissues of many plants. For instance, flaxseed and family Malvaceae plant tissues have proven excellent sources of lubricant and/or coolant mucilages. Although natural sources are preferred, lubricants and/or coolants according to the present invention also can be based on substantially linear polysaccharides that are chemically synthesized. However, naturally occurring, low molecular weight, electrically neutral polymers will probably not be as effective.

Preparation of mucilage from plant tissue involves either direct, physical extraction of the mucilage from plant tissue (e.g. crushing the tissue to release mucilage fluid), or solvent-facilitated extraction (e.g. soaking or heating and soaking plant tissue in water or another polar solvent to release mucilage extract), or a combination of these processes. Optionally the insoluble plant tissue (mash) subsequently can be removed from the fluid.

Additional amounts of mucilage can be extracted from plant tissue by soaking it in a further volume of solvent. To do this, mash from the first extraction is mixed with a further volume of solvent, the mixture optionally heated and agitated to facilitate release of further mucilage extract, and insoluble plant material once again removed. In such a manner, it may be possible to attain as much as 20 gallons of mucilage extract from a single pound of plant tissue. The amount of mucilage released with each successive extraction (per gallon of solvent) will likely decrease. Successive batches may be mixed together to attain a large volume of extract at a single viscosity, or successive batches can be used for different machining purposes.

The temperature of the extracting solvent (e.g. water) and extraction process is generally immaterial to the lubricating and cooling characteristics of the resultant mucilage extract. It is therefore possible to prepare such extract using any temperature of water, from ice cold to boiling. Heating may decrease the amount of time necessary to soak the plant tissue in order to extract the mucilage, and therefore it will be beneficial in some circumstances to heat the solvent and/or the solvent and plant tissue mixture.

Preservatives, including antioxidants (anti-rust agents) or anti-microbial compounds (fungicides, bactericides, bacteriostatics, etc.), should be added in order to inhibit microbial growth in and consequent degradation of the mucilage. An anti-microbial preservative should be used in an amount effective to substantially inhibit microbial growth in and consequent degradation of the lubricant, preferably in an amount ranging from about 0.01 to about 3 percent. An antioxidant preservative, for instance hydrogen peroxide, amine or carboxylic acid salts, may be added to prevent oxidation and resultant corrosion and, if included, is present in an amount effective to prevent such corrosion, preferably in an amount ranging from about 0.001 to about 8 percent.

1. General Procedure for Preparing Malvaceae Mucilage.

Tissue from diverse members of the Malvaceae family has been used for preparation of an effective mucilage-containing lubricating and/or cooling composition. Okra pods have proven to be a particularly good source for such mucilage, though the leaves, stems, and flowers also contain this substance. Ornamental hibiscus tissues contain appropriate mucilage. Cotton is a member of the taxonomic family Malvaceae, and cotton leaves contain lubricating and/or cooling mucilage. In fact, many members of the taxonomic family Malvaceae contain mucilaginous components. See, for instance, Yamada et al. (1985) Carbo. Res. 144:101–111 (inter alia, comparison of polysaccharides from mucilage found in several Abelmoschus species) and Tomada et al. (1988) *Cabro. Res.* 190:323–328 (comparison of several okra and hibiscus mucilage polysaccharides). We therefore expect that effective lubricating and/or cooling extracts can be produced from any member of this taxonomic family.

Okra pods, which may be fresh, frozen, or dried, for example, are cut, crushed, macerated, homogenized, etc., in order to disrupt the pod tissue. Okra mucilage is then extracted from the disrupted tissue either physically and/or through solvent-assisted techniques using a polar solution such as tap water. The extraction generally can be performed with heating (e.g., to boiling) to accelerate the extraction process, without substantially altering the performance of the resultant product. After extracting the mucilage, insoluble Malvaceae tissue (mash) can be removed by filtering, centrifugation, or other conventional methods in order to produce a fluid that includes the okra mucilage. Further mucilage can be extracted from the okra mash by repeating the extraction process in the presence of further solvent.

At least one component of the Malvaceae mucilage can be a long-chain, high molecular-weight glycan containing rhamnose, galactose, and galacturonic acid monosaccharide residues in a relative molar ratio of about 10:27:25 (U.S. Pat. No. 4,154,822 "Polysaccharide for Enhancement of Cardiac Output"). This glycan is substantially linear, negatively charged, and has an apparent molecular weight of at least $10^6$ daltons (the glycan is retained on a molecular sieve designed to allow passage of globular molecules having a molecular weight of less than about $10^6$).

2. General Procedure for Preparing Flax Mucilage.

Mucilage and mucilage extract can be prepared from whole or crushed flaxseed, or linseed meal, in a manner similar to that discussed above for tissue from plants of the family Malvaceae.

The temperature of the extraction process is of greater importance when the plant tissue employed is flaxseed. Flaxseed contains a large amount of the protein collagen, which denatures upon heating and forms a gel-like substance during subsequent cooling. Though this is not detrimental to the lubricating and cooling characteristics of the resultant extract, it greatly increases the viscosity of the preparation. See Example Five, below. This may be beneficial in certain applications, for instance where it is advantageous to keep the coolant/lubricant from flowing away from the point of application.

Flaxseed, either whole or crushed, or linseed meal, is added to an amount of polar solution such as tap water, and extraction performed at any temperature up to 180° F. If heat is employed, the mix is optionally permitted to cool afterwards, then the insoluble flaxseed material (mash) is removed (e.g. by filtration, centrifugation, or other conventional method) to yield flaxseed mucilage extract. As discussed above under preparation of Malvaceae mucilage, it is possible to extract further mucilage from the flaxseed mash by repeated extraction cycles.

3. Addition of Preservative.

In order to extend the useful life of the cooling and/or lubricating compositions disclosed here, a preservative is added to the mucilage or mucilage extract. Any, preferably environmentally benign, conventional anti-microbial preservative may be added to inhibit microbial growth in and degradation of the mucilage or extract including, but not limited to, quaternary salts such as benzalkonium chloride, tris(hydroxymethyl)nitromethane, and THPS. Other possible anti-microbial preservatives include grapefruit seed extract, sodium sulfite, isopropyl alcohol, citric acid, calcium propionate, EDTA, hydrogen peroxide, propylene glycol, colloidal silver, colloidal silver essence, and olive leaf extract. Combinations of these materials can also be used. The anti-microbial preservative should be present in an amount effective to substantially inhibit microbial growth in and degradation of the lubricant, in an amount ranging from about 0.001 to about 8, preferably from about 0.01 to about 4 percent, and more preferably from about 0.01 to about 3 percent.

III. Optional Post-Extraction Processing of the Mucilage-Containing Composition

After preparation of the basic composition, optional ingredients may be added. Such additives include surfactants, preservatives, antioxidant (anti-rust) agents, pH buffers, or other conventional additives. The consistency of the composition also can be customized through dilution or concentration processes.

1. Further additives.

A lubricant and/or coolant according to the present invention may optionally further include one or more additives, such as surfactants, antioxidant preservatives, pH buffers, or other conventional additives including aesthetic materials (dyes, fragrances, etc.). Preferably, such additives are substantially environmentally benign.

Any conventional surfactant may be used to provide uniform coverage of the lubricant and/or coolant on a machining surface to which it is applied and to facilitate removal of composition residues. The surfactant is preferably non-foaming and non-reactive with the surface to which the lubricant is applied. The surfactant is preferably included in an amount ranging from about 0 to 10 percent, preferably 1 to 6 percent, and even more preferably 1 to about 4 percent.

In addition to the preservative added in order to increase the useful life of the composition, any conventional antioxidant preservative may be used to prevent oxidation and resultant corrosion and, if included, is present in an amount effective to prevent such corrosion, preferably in an amount ranging from about 0.001 to about 8 percent, preferably about 0.01 to about 4 percent, and more preferably from about 0.01 to about 3 percent. Such antioxidants include, but are not limited to, hydrogen peroxide or amine or carboxylic acid salts, such as triethanolamine, EDTA, amine borates, amine carboxylates, and mixtures thereof.

If necessary or desired, a conventional buffering agent may be added to maintain a neutral or other desired pH and thus prevent oxidative corrosion of, or other damage to, surfaces to which the lubricant and/or coolant is applied and/or to prolong the shelf-life of the lubricant and/or coolant composition. Alternatively, the pH of the lubricant can be adjusted to a desired point by addition of a conventional acid or base.

If desired for particular embodiments of the invention, one or more aesthetic material such as a dye or fragrance can be added.

A lubricant and/or coolant according to another embodiment of the present invention includes a combination of mucilage and one or more other lubricating and/or cooling substances that are known in the art, particularly water miscible substances. Such substances include, but are not limited to, polyhydric alcohols, such as polyethylene glycol, and glycerin.

2. Adjustment of Composition Consistency.

Certain applications for which the present lubricant and/or coolant composition is appropriate may require that the consistency of the composition be tailored. For instance, in applications wherein the lubricant and/or coolant will be sprayed intermittently or continuously onto a machining surface, it may be advantageous to employ a dilute (less viscous) lubricant and/or coolant. Dilute preparations tend to flow more freely. Also, such preparations likely will flow more freely into narrow gaps. Alternately, in some spraying applications a very viscous lubricant and/or coolant may be applied, and water applied separately, either continuously or intermittently. For those applications for which it is advantageous that the lubricant and/or coolant remain localized to a relatively small area, e.g., certain drilling processes, it may be beneficial to employ a less dilute (more viscous) lubricant and/or coolant composition. The more viscous composition will be less apt to flow from the working area, and may advantageously cling to the machining surface. Those of ordinary skill in the machining arts will understand which applications will require the use of more or less viscous cooling and/or lubricating compositions.

It also can be advantageous to concentrate the lubricant and/or coolant composition to reduce its storage volume or for more compact shipping. One of ordinary skill in the art will understand the inherent advantages of shipping a concentrated product and permitting the user subsequently to dilute it to the desired consistency after purchase and/or delivery.

It may be advantageous in some circumstances to convert the lubricant and/or coolant composition into a dry form, for instance a powder. The essentially complete removal of liquid component further reduces the volume and weight of the composition beyond that achieved by concentration. Drying of the composition can be achieved using conventional means, including for instance evaporation, vacuum-assisted evaporation, and spray drying processes. A completely dry product will in some circumstances allow more convenient and efficient storage and shipping. In addition to smaller shipping volume, dry powdered product can be shipped in a wider variety of containers than can fluid product. Advantageously, the dried composition can be shipped to the consumer, and measured portions reconstituted with a solvent of choice only when the lubricant and/or coolant is needed. It is a further advantage of drying the lubricating and/or cooling composition that microbial degradation may be reduced while the composition is dry. As with the original composition, reconstituted mucilage can be diluted to various consistencies with water or other solvents or solutions for use in different machining processes.

IV. Use of Coolant and/or Lubricant

The compositions of this invention can be used generally as coolants and/or lubricants in a variety of mechanical and industrial applications. For instance, the compositions can be used to lubricate and/or cool machining processes (for instance, sawing, drilling, planing, milling, folding, rolling, grinding, and lathing) as well as in a variety of other applications, including engine radiators and air conditioners. In such applications the disclosed compositions are used essentially as are conventional coolants and/or lubricants. These methods of use will be known to one of ordinary skill in the relevant art. One of ordinary skill will appreciate that other applications would benefit from the use of the disclosed compositions as coolants.

The lubricating qualities of these compositions also render them useful as utility lubricants. Such lubricants are used on, for instance, rubber gaskets, O-rings, grommets, and other rubber seals, and in (for example) the sealed joints of pipes, storm drains, pressurized lines, and underground and above ground utility lines. As would be appreciated by one of ordinary skill in the relevant art, other applications than those listed would benefit from the use of the disclosed compositions as a lubricant.

V. Watercraft Outer Hull Coating

Extracts of the present invention also may be used to coat the outer hull surface of watercraft to reduce drag and friction of the craft as it moves through water, thereby increasing the speed of the watercraft. In general, mucilage and mucilage extract for use in watercraft coating should be viscous, such that it can be brushed onto the dry surface of a watercraft hull. Alternately, mucilage or mucilage extract as disclosed can be mixed with a wax or cream wax (U.S. Pat. No. 3,955,999 Cream Wax and the Method of Preparation Thereof). The cream wax-based watercraft coating can be applied by conventional means, including spreading, rubbing, spraying, or painting it on the dry surface of the watercraft hull.

Because the mucilage-containing materials disclosed herein are substantially environmentally benign, their application to the outer hull of watercraft should pose no environmental hazards. However, because these substances are generally water-soluble and/or water miscible, it may be necessary to periodically re-apply the outer-hull coating. How often such re-application is needed will depend on how much the watercraft is used, as well as the thickness of the hull coating applied, and various environmental factors including water temperature and watercraft speed.

The invention will be better understood by reference to the following Examples, which are intended to merely illustrate features now known for practicing the invention. The scope of the invention is not limited to those features disclosed in the Examples.

EXAMPLES

Example One

Preparation of Malvaceae Extract-Based Lubricant and/or Coolant a. Okra: Four pounds of fresh okra were chopped coarsely and soaked in four gallons of tap water at room temperature for 12 hours. The mixture was agitated intermittently to facilitate the extraction of mucilage. Subsequently, the insoluble okra tissue was strained from the fluid. Colloidal silver (0.015 percent) and hydrogen peroxide (3 percent) were added to the extract as preservatives. The composition produced was a predominantly translucent, viscous fluid varying in color from nearly clear to dark brown.

Okra extract has been prepared repeatedly, varying specific features of this process, including the amount of okra, water, and preservatives, the temperature and time of the extraction process, and the specific tissue used. For instance, similar extract can be prepared using okra leaves, though the amount of mucilage released per pound of starting plant tissue is generally lower than that released from seed pods.

b. Ornamental hibiscus: Using a procedure essentially similar to that described for okra pod tissue, mucilage extract was produced from the flowers and stem/leaf tissues of an ornamental hibiscus plant (*Anisodentea x hypomadarum*, commonly known as South African mallow).

c. Cotton: One pound of cotton leaves was shredded and placed in one gallon of tap water. The water was heated to 180° F., held at that temperature for five minutes then allowed to cool and soak for 12 hours. Insoluble leaf material was then strained from the extract. This cotton leaf extract displayed similar appearance and performance characteristics to that displayed by okra pod and leaf extracts, though less mucilage was released than from okra pods.

Example Two

Preparation of Flaxseed Extract-Based Lubricant and/or Coolant

One pound of whole flaxseed was mixed in one gallon of water and heated to 180 F for five minutes, then allowed to cool and soaked for a total of 12 hours. The insoluble plant tissue was then removed by straining. Grapefruit seed extract was added to a final amount of 2% (volume/volume). In appearance, the flax extract was substantially similar to extract from Malvaceae species, though it tended to be more viscous. Unlike Malvaceae species, no appreciable amount of mucilage was released from flax stems, leaves, or flowers.

Example Three

Concentration of Lubricant and/or Coolant

A plant extract containing okra mucilage was prepared as described in Example One, then evaporated to approximately one fourth its original volume. A portion of this concentrated extract was then re-diluted to roughly the original volume using tap water.

The extract can be optionally diluted to a concentration lower than that yielded directly from the plant tissue extraction process in order to yield a version of the lubricating and/or cooling composition that is less viscous. Dilution beyond 20 gallons of final extract for each pound of starting plant material is not recommended, as this concentration may be too low to provide adequate lubricating and/or cooling properties.

Example Four

Drying of Lubricant and/or Coolant

Aqueous extract containing okra mucilage was prepared as described in Example One, then evaporated to dryness. This produced a cake of tan/light brown solid, which was subsequently comminuted to a powder using a grinder. The dried, powdered extract was then reconstituted by adding two tablespoons of powdered extract to one gallon of water. The reconstituted extract demonstrated lubricating and cooling properties in wood sawing and metal drilling applications similar to that of the okra mucilage according to Example One.

Optional additives as discussed above in Example One can be added before the drying process, and dried down with the extract. Alternately, those optional additives that are themselves powders can be added after the extract is dried and powdered. It is also possible to leave some or all desired additives out of the extract until after the product has been reconstituted, and then add them. This third option requires that the consumer selects, measures and mixes the appropriate additives when reconstituting the extract; this also allows the consumer the greatest flexibility in relation to the final product.

Example Five

Analysis of Lubricant and/or Coolant Composition

The viscosity of plant extracts as prepared in Examples One and Two from okra pods and flaxseed were measured using a Haake RS100 viscometer (HAAKE, Paramus, N.J.) using a parallel plate test configuration. In each case, one pound of plant material was extracted for twelve hours in one gallon of water either at room temperature or heated to 180° F. for five minutes, then allowed to cool to room temperature. Insoluble plant material was removed by filtration.

The viscosity of each sample was measured at a temperature of 23 ° C. The test procedure used was a flow curve, where the viscosity was measured over a range of shear rates. The samples were shear thinning. That is, the viscosity decreased as the test shear rate was increased. This means that the viscosity is dependent on the shear rate at which the sample is tested. Viscosity values (centipoise) at selected shear rates ($sec^{-1}$) are listed in Table 1.

TABLE 1

Viscosity of lubricant and/or coolant extracts.

| Sample | 10/sec | 20/sec | 50/sec | 100/sec |
|---|---|---|---|---|
| Okra (cool) | 12 | 7 | 4 | 4 |
| Flaxseed (cool) | 30 | 26 | 21 | 18 |
| Flaxseed (hot) | 2300 | 1500 | 550 | 300 |

"Cool" designates extraction at room temperature; "hot" designates extraction under heated conditions (raised to 180° F. and held for 5 minutes, then allowed to cool).

Extracts prepared as in Examples One through Four were tested as lubricants by applying them to saw blades during milling of lumber and to bits during metal drilling. Extracts from both okra and flaxseed provided excellent lubrication for the saw blade and cut wood surfaces, and to the bit and metal surface, respectively. Extracts from hibiscus and cotton tissue performed similarly. In addition, both the fourfold concentrated and subsequently re-diluted okra pod and flaxseed compositions demonstrated excellent lubricating and cooling properties. Residues of each lubricant could be removed easily from the blade or drill and from the cut surfaces by washing with water.

In addition, the coolant characteristics of the extracts were tested by measuring the temperature of the drill bit and drilled metal surface both before and after drilling with or without conventional coolant/lubricant, and in the presence of okra extract, and flax extract. Specifically, a Jancy Slugger™ magnetic drill press (Jancy Engineering Co., Davenport, Iowa) with a ⅞ inch bit was used to drill through a ½ inch thick plate of mild steel. Temperatures were measured using an Rā-Tek Infrared Surface Pyrometer (Rā-Tek Precision Sheet Metals, Inc., Morgan Hill, Calif.). The temperature of the drill and steel plate was 64.8° F. prior to the drilling process. When the drill was used without any form of coolant, the final temperature of the drill and steel plate was 138° F. When cutting oil or "3 in 1" oil was applied prior to drilling, the final temperature of the bit and plate was 120–128° F. When okra-based extract was placed on the steel plate or drill bit prior to drilling, the final temperature of the drill bit and steel plate was 81° F. Flax-based extract produced similar results, with the final temperature of the bit and steel plate measured at 88.1° F.

The potential for industrial use of the okra extract was tested at a functional lumber mill, where both the lubricating and cooling characteristics of the extract could be examined. The mill at which tests were preformed was not open to the public during testing.

In a standard, high-speed mill operation, lubrication and cooling is provided by a mixture of water and lubricant solution, sprayed directly onto the cutting interface between saw blade and wood. Three spray jets are usually involved, two of which supply water continuously at a rate of 7 gallons per minute, while the third jet intermittently provides approximately 2¼ gallons per hour of for instance, Sawglide solution (Unical). Alternately, a single jet application system can be used.

To test the performance of okra-based composition, it was prepared as in Example One, providing a final volume of one gallon of extract from each pound of okra pods. Using a three-jet lubricating system, this extract was applied intermittently at a rate of 4½ gallons per hour to a McGeehee 12 gang edger, and the continuous water application reduced to 3 or fewer gallons per minute. This amount of water and extract provided excellent sawing conditions, and produced planks without scorch marks or other damage associated with inadequate cooling and/or lubrication.

Example Six

Reclamation of lubricant and/or coolant

A further benefit of the present lubricant and/or coolant is that it is simple to reclaim the product after its use, and to refurbish it for re-use. The used composition can be collected both at the point of the machining process, for instance under the cutting region of a mill saw, and at the point where the lubricant and/or coolant composition is washed off of the cut wood or other machined product. Such recaptured lubricant and/or coolant can then be filtered to remove particulate material, including for instance saw dust and wood or metal shavings. It also may be advantageous to concentrate the resultant reclaimed lubricant and/or coolant by evaporation or other means, as discussed above, to remove excess liquid provided during use or the reclamation process. The cooling and lubricating characteristics of the reclaimed composition are essentially similar to those of the composition produced in Examples One through Four.

Example Seven

Drag-Reducing Watercraft Outer Hull Coating

Extracts herein disclosed may also be used to coat the outer hull surface of water craft, reducing the drag and friction of the craft as it moves through water, thereby increasing the speed of the water craft. One pound of okra pods is cut into pieces and soaked in water for approximately 12 hours, then insoluble plant tissue is strained from the extract. This extract is reduced to one half volume by evaporation, and the resultant viscous extract brushed onto the dry surface of a water craft hull. The extract is allowed to dry thoroughly, and optionally a second coat is applied.

The outer hall of a 1/36 scale model boat approximately 18 inches long was coated with okra mucilage-containing outer hull coating, and allowed to dry thoroughly. The water speed of the model with coating was then measured and compared to that measured without extract; the friction reduction caused a speed increase of about 33 %.

Example Eight

Combustion Engine Coolant

Extracts disclosed herein also may be used as radiator coolants in combustion engines, for instance the engine of an automobile. Two pounds of okra pods was cut into pieces and soaked in two gallons water for approximately 12 hours, then insoluble plant tissue strained from the extract. This extract (2 gallons final) is then placed into the radiator of an automobile engine in place of the conventional coolant/water mixture.

Extract as described was used in the radiators of two I.M.T.A. modified racecars with 350 Chevy engines. After racing the cars, the temperatures of the coolant and engine oil were compared to those in a control car engine using standard Redline Water Wetter engine coolant. The control car coolant (Redline Water Wetter) temperature ranged from 230–240° F.; the okra-based coolant/lubricant maintained a temperature of 190–200° F. The oil in the control car engine ranged from 190–200° F., the temperature of the oil in the okra-extract cooled car ranged from 140–160° F.

The foregoing examples are provided by way of illustration only. One of ordinary skill in the art will appreciate that numerous variations on the plants, processes, and methods described above may be employed to produce and use coolant and/or lubricant herein described. We claim all such subject matter that falls within the scope and spirit of the following claims.

We claim:

1. A cooling and/or lubricating composition, comprising:

a mucilage; and a sufficient amount of a preservative to substantially inhibit degradation of the composition.

2. The composition according to claim 1 wherein the preservative is selected from the group consisting of benzalkonium chloride, tris(hydroxymethyl)-nitromethane, THPS, grapefruit seed extract, sodium sulfite, isopropyl alcohol, citric acid, calcium propionate, EDTA, hydrogen peroxide, propylene glycol, colloidal silver, colloidal silver essence, olive leaf extract, and mixtures thereof.

3. The composition according to claim 2 wherein the amount of preservative is about 0.001 to about 8 percent.

4. The composition according to claim 1 comprising a sufficient amount of the mucilage to cool and/or lubricate a machining surface.

5. The composition according to claim 4, where the composition is an aqueous composition.

6. The composition according to claim 4 wherein the mucilage is extracted from a plant tissue selected from the group of plants consisting of flax, members of the taxonomic family Malvaceae, and mixtures thereof.

7. The composition according to claim 6 wherein the plant tissue is okra plant tissue.

8. The composition according to claim 7 wherein the okra plant tissue is okra pods.

9. The composition according to claim 6 wherein the plant tissue is flax plant tissue.

10. The composition according to claim 9 wherein the flax plant tissue is flaxseed.

11. A cooling and/or lubricating composition, comprising:

a sufficient amount of a mucilage to cool and/or lubricate a machining surface, wherein the mucilage is extracted from a plant tissue selected from the group of plants consisting of hibiscus, okra, cotton, flax, and mixtures thereof, and a sufficient amount of a preservative selected from the group consisting of benzalkonium chloride, tris (hydroxymethyl)-nitromethane, THPS, grapefruit seed extract, sodium sulfite, isopropyl alcohol, citric acid, calcium propionate, EDTA, hydrogen peroxide, propylene glycol, colloidal silver, colloidal silver essence, olive leaf extract, and mixtures thereof, to substantially inhibit the degradation of the composition.

12. The composition according to claim 11 wherein the mucilage is extracted from okra, and the preservative is 0.015 percent colloidal silver and 3 percent hydrogen peroxide.

13. The composition according to claim 11 wherein the mucilage is extracted from flaxseed, and the preservative is 0.015 percent colloidal silver and 3 percent hydrogen peroxide.

14. The composition according to claim 1 wherein the mucilage comprises a substantially linear glycan having an apparent molecular weight of at least $10^6$ daltons.

15. The composition according to claim 14 wherein the glycan comprises rhamnose, galactose, and galacturonic acid.

16. The composition according to claim 14 wherein the composition comprises a sufficient amount of the glycan to cool and/or lubricate a machining surface.

17. The composition according to claim 16 wherein the mucilage is extracted from a plant tissue selected from the group of plants consisting of flax, members of the taxonomic family Malvaceae, and mixtures thereof.

18. The composition according to claim 17 wherein the plant tissue is okra plant tissue.

19. The composition according to claim 18 wherein the okra plant tissue is okra pods.

20. The composition according to claim 17 wherein the plant tissue is flax plant tissue.

21. The composition according to claim 20 wherein the flax plant tissue is flaxseed.

22. A cooling and/or lubricating composition, comprising:

a sufficient amount of a substantially linear glycan to cool and/or lubricate a machining surface, the glycan having an apparent molecular weight of at least $10^6$ daltons and comprising rhamnose, galactose, and galacturonic acid, wherein the glycan is extracted from a plant tissue selected from the group of plants consisting of hibiscus, okra, cotton, and mixtures thereof; and a sufficient amount of a preservative selected from the group consisting of benzalkonium chloride, tris (hydroxymethyl)-nitromethane, THPS, grapefruit seed extract, sodium sulfite, isopropyl alcohol, citric acid, calcium propionate, EDTA, hydrogen peroxide, propylene glycol, colloidal silver, colloidal silver essence, olive leaf extract, and mixtures thereof, to substantially inhibit the degradation of the composition.

23. A method for making a cooling and/or lubricating composition, comprising extracting a mucilage; and adding a sufficient amount of a preservative to substantially inhibit degradation of the composition.

24. The method according to claim 23 further comprising the additional step of substantially removing an insoluble plant component.

25. The method according to claim 24 wherein the step of extracting a mucilage comprises crushing an amount of plant tissue to release a fluid component from the insoluble plant component prior to the step of substantially removing the insoluble plant component.

26. The method according to claim 24 wherein the step of extracting a mucilage comprises soaking an amount of plant tissue in a sufficient amount of fluid for a sufficient amount of time to extract a mucilage extract prior to the step of substantially removing the insoluble plant component.

27. The method of claim 23 wherein the mucilage is extracted from a plant tissue selected from the group of plants consisting of flax, members of the taxonomic family Malvaceae, and mixtures thereof.

28. The method of claim 27 wherein the plant tissue is okra plant tissue.

29. The method of claim 28 wherein the okra plant tissue is okra pods.

30. The method of claim 27 wherein the plant tissue is flax plant tissue.

31. The method of claim 30 wherein the flax plant tissue is flaxseeds.

32. The method of claim 21 further comprising the additional step of adding an antioxidant to the mucilage.

33. The method of claim 32 wherein the amount of the antioxidant is from about 0.001 to about 8 percent.

34. The method of claim 32 wherein the antioxidant is selected from the group consisting of amine or carboxylic acid salts.

35. The method according to claim 23 wherein the preservative is selected from the group consisting of benzalkonium chloride, tris(hydroxymethyl)-nitromethane, THPS, grapefruit seed extract, sodium sulfite, isopropyl alcohol, citric acid, calcium propionate, EDTA, hydrogen peroxide, propylene glycol, colloidal silver, colloidal silver essence, olive leaf extract, and mixtures thereof.

36. The method of claim 35 wherein the amount of the preservative is from about 0.001 to about 8 percent.

37. The method according to claim 24 further comprising the additional step of concentrating the mucilage after the step of removing the insoluble plant component.

38. The method according to claim 37 wherein the step of concentrating the mucilage comprises evaporation of volatile materials.

39. The method according to claim 36 wherein the step of concentrating the mucilage comprises evaporation of volatile materials for a period of time sufficient to dry the mucilage.

40. The method according to claim 23 further comprising the additional steps of concentrating the mucilage by evaporation of volatile materials for a period of time sufficient to dry the mucilage;

comminuting the dry mucilage to a powder; and reconstituting the powder in a fluid, prior to the step of adding a sufficient amount of a preservative to substantially inhibit degradation of the composition.

41. A method for making a cooling and/or lubricating composition, comprising extracting a mucilage;

adding a sufficient amount of a preservative to substantially inhibit degradation of the mucilage to make a mixture;

concentrating the mixture by evaporation of volatile materials for a period of time sufficient to dry the mixture;

comminuting the dry mixture to a powder; and reconstituting the powder in a fluid.

42. The method according to claim 41 further comprising the additional step of adding a sufficient amount of a preservative to substantially inhibit degradation of the composition after reconstituting the powder.

43. The powder produced as an intermediate according to claim 40.

44. The powder produced as an intermediate according to claim 41.

45. A cooling and/or lubricating composition produced by the method of claim 23.

46. A cooling and/or lubricating composition produced by the method of claim 25.

47. A cooling and/or lubricating composition produced by the method of claim 27.

48. A method for machining a surface, comprising extracting a mucilage;

adding a sufficient amount of a preservative to substantially inhibit degradation of the mucilage, thereby forming a mucilage mixture;

applying the mucilage mixture to a surface to be machined; and machining the surface.

49. The method according to claim 48 wherein the step of applying the mucilage mixture comprises applying the mucilage mixture to metal, plastic, synthetic polymer, naturally occurring polymer, synthetic composite, glass or wood.

50. The method according to claim 45 further comprising the additional step of substantially removing an insoluble plant component.

51. The method according to claim 50 wherein the step of extracting a mucilage comprises crushing an amount of plant tissue to release a fluid component from the insoluble plant component prior to the step of substantially removing the insoluble plant component.

52. The method according to claim 50 wherein the step of extracting a mucilage comprises soaking an amount of plant tissue in a sufficient amount of fluid for a sufficient amount of time to extract the mucilage prior to the step of substantially removing the insoluble plant component.

53. The method according to claim 52 wherein the fluid is selected from the group consisting of water, solvents sufficiently polar to extract the mucilage, and mixtures thereof.

54. A method for lubricating and/or cooling a machining surface, comprising extracting a mucilage;

adding a sufficient amount of a preservative to substantially inhibit degradation of the mucilage, thereby forming a mucilage mixture; and applying the mucilage mixture to the machining surface to act as a lubricant and/or coolant.

55. The method according to claim 54 wherein the machining surface is a saw blade, a drill bit, a plane, a milling edge, a folding edge, a roller, a wheel, a grinding bit, a burr, or a lathe blade.

56. The method according to claim 55 further comprising the additional step of substantially removing an insoluble plant component.

57. The method according to claim 56 wherein the step of extracting a mucilage comprises crushing plant tissue to release a fluid component from the insoluble plant component prior to the step of substantially removing the insoluble plant component.

58. The method according to claim 54 wherein the step of extracting a mucilage comprises soaking an amount of plant material in a sufficient amount of fluid for a sufficient amount of time to extract the mucilage prior to the step of substantially removing the insoluble plant component.

59. The method according to claim 58 wherein the fluid is selected from the group consisting of water, solvents sufficiently polar to extract the mucilage, and mixtures thereof.

60. A cooling and/or lubricating composition, comprising a sufficient amount of okra pod mucilage to function as a machining coolant and/or lubricant; and a sufficient amount of sodium sulfite to substantially inhibit the degradation of the composition.

61. A cooling and/or lubricating composition, comprising a sufficient amount of flaxseed mucilage to function as a machining coolant and/or lubricant; and a sufficient amount of sodium sulfite to substantially inhibit the degradation of the composition.

62. A cooling and lubricating composition, comprising a mixture of between 0% and 100% of a first cooling and/or lubricating composition, comprising a sufficient amount of okra pod mucilage to function as a machining coolant and/or lubricant; and a sufficient amount of sodium sulfite to substantially inhibit the degradation of the composition; and between 100% and 0% of a second cooling and/or lubricating composition, comprising a sufficient amount of flaxseed mucilage to function as a machining coolant and/or lubricant; and a sufficient amount of sodium sulfite to substantially inhibit the degradation of the composition.

63. A method for lubricating and/or cooling a saw blade or drill bit, comprising making a lubricating and/or cooling fluid by the steps of soaking okra pods in a sufficient amount of water for a sufficient amount of time to extract a mucilage extract;

substantially removing insoluble plant material;

adding sodium sulfite in an amount sufficient to substantially inhibit degradation; and evaporating sufficient water to provide an effective machining lubricant and/or coolant; and applying the lubricating and/or cooling fluid to the saw blade or drill bit to act as a lubricant and/or coolant.

64. A method for lubricating and/or cooling a saw blade or drill bit, comprising making a lubricating and/or cooling fluid by the steps of soaking flaxseed in a sufficient amount of water to extract a mucilage extract;

heating the mucilage extract to about 180° F. for about five minutes;

substantially removing insoluble plant material;

adding sodium sulfite in an amount sufficient to substantially inhibit degradation; and evaporating sufficient water to provide an effective machining lubricant and/or coolant; and applying the lubricating and/or cooling fluid to the saw blade or drill bit to act as a lubricant and/or coolant.

65. A watercraft outer hull coating composition, comprising a mucilage.

66. The composition according to claim 65 further comprising a cream wax.

* * * * *